US005205544A

United States Patent [19]

Kroeger

[11] Patent Number: 5,205,544

[45] Date of Patent: Apr. 27, 1993

[54] REMOTELY CONTROLLED WINCH

[76] Inventor: Donald E. Kroeger, R.R. #1, Elkhorn, Nebr. 68022

[21] Appl. No.: 663,245

[22] Filed: Mar. 1, 1991

[51] Int. Cl.[5] ..... B66D 1/00; B66D 1/08; B66C 1/34

[52] U.S. Cl. ..... 254/329; 254/361; 294/82.12

[58] Field of Search ..... 254/361, 329, 273; 294/82.12, 81.3, 67.5; 212/160

[56] References Cited

U.S. PATENT DOCUMENTS

| | | | |
|---|---|---|---|
| 3,191,787 | 6/1965 | Stearn | 294/74 X |
| 3,253,851 | 5/1966 | Gilbert | 294/81.4 X |
| 3,428,298 | 2/1969 | Powell | 254/361 X |
| 3,596,968 | 8/1971 | Holm | 294/81.3 |
| 3,687,418 | 8/1972 | Halvorsen | 254/361 X |
| 3,695,473 | 10/1972 | Martin | 254/361 X |
| 3,709,548 | 1/1973 | Hogshead | 294/74 |
| 3,799,358 | 3/1974 | Putnam | 212/160 |
| 3,858,728 | 1/1975 | Fathauer | 212/160 |
| 4,448,396 | 5/1984 | Delago | 254/361 X |
| 4,544,070 | 10/1985 | Sickler | 254/361 X |

FOREIGN PATENT DOCUMENTS

| | | | |
|---|---|---|---|
| 361967 | 12/1972 | U.S.S.R. | 294/67.5 |
| 0495262 | 3/1976 | U.S.S.R. | 294/82.12 |
| 751779 | 7/1980 | U.S.S.R. | 294/82.12 |
| 998288 | 2/1983 | U.S.S.R. | 294/82.12 |
| 2063210 | 6/1981 | United Kingdom | 294/81.3 |

*Primary Examiner*—Daniel P. Stodola
*Assistant Examiner*—Michael R. Mansen
*Attorney, Agent, or Firm*—Zarley, McKee, Thomte, Voorhees & Sease

[57] ABSTRACT

A remotely controlled winch designed for use with a tower crane located at a building site to enable a building panel to be raised from the bed of a truck into the proper position for installation on the side of the building. The building panel normally rests on one of its side edges on the truck bed. The winch includes a frame which is secured to the hoisting cable of the tower crane. A sheave is secured to the lower end of the frame and has a first cable mounted thereon with the ends thereof being removably secured to the upper end of the building panel. A remotely controlled hydraulic winch is mounted on the frame and has a winch cable extending therefrom which is operatively secured to the other side edge of the building panel adjacent the lower end thereof. The tower crane is initially operated to cause the hoisting cable thereof to be moved upwardly which causes the building panel to be raised from the truck. The hydraulically operated winch is then remotely operated to lower the winch cable thereof so that the building panel is rotated 90° into an upright position.

4 Claims, 5 Drawing Sheets

REMOTELY CONTROLLED WINCH

BACKGROUND OF THE INVENTION

This invention relates to a remotely controlled winch means and more particularly to an apparatus which may be used in conjunction with a tower crane to enable the tower crane to lift a building panel from the bed of a truck and rotate the same into the proper position for attachment to the exterior of the building.

Pre-cast building panels are used extensively on the exteriors of large buildings. The building panels are normally cast at a location remote from the building site and it is necessary to transport the building panels to the job site where they are installed on the exterior of the building. Inasmuch as the building panels are normally rectangular and have a considerable height, the panels must be transported on their sides on a truck or trailer to the building site. Since the panels are resting on the truck bed on their sides, it is necessary to lift the panels from the truck and to then rotate the same 90° so that the upper end of the building panel is positioned uppermost. Conventional practice has been to utilize a pair of cranes at the building site with the hoisting cable of the building or tower crane being secured to the upper end of the building panel with the hoisting cable of the second crane being secured to the side edge of the building panel. The second crane lifts the building panel upwardly from the truck until the panel has sufficiently cleared the truck whereupon the hoisting cable of the tower crane is moved upwardly to rotate the panel 90°. Such a procedure requires that a second crane be at the building site which does entail considerable expense.

Applicant previously devised a remotely controlled winch means which was the subject of a patent application Ser. No. 815,649 filed Jan. 2, 1986, now abandoned. The winch means of the abandoned application was electrically operated and generally worked in a satisfactory manner. However, it was found that the electrically operated winch did not have the capacity to manipulate extremely large building panels. Further, if the electric motor in the previous device were to fail, there is a possibility that an accident could occur.

It is therefore a principal object of this invention to provide a remotely controlled winch means.

It is also a principal object of the invention to provide a remotely controlled winch means which may be used to facilitate the lifting of a building panel from the bed of a truck.

A further object of the invention is to provide an apparatus which may be used with a tower crane to enable the crane to lift a building panel from the bed of a truck.

A further object of the invention is to provide an apparatus which may be used with a crane to lift a building panel from the bed of a truck so that the necessity of a second crane is avoided.

Yet another object of the invention is to provide a remotely controlled winch means wherein winch is controlled and operated by a hydraulic motor which is operatively connected thereto through a hydraulic brake and gear reducer.

Still another object of the invention is to provide an apparatus which is safe to use.

These and other objects will be apparent to one skilled in the art.

SUMMARY OF THE INVENTION

A remotely controlled winch means is disclosed which may be used with a tower crane to facilitate the lifting of building panels from the bed of a truck. When the building panels arrive at the building site, they are normally positioned on the bed of a truck on one of their sides with the upper end of the building panels being positioned either adjacent the truck cab or the rear end of the truck bed. The remotely controlled winch means of this invention includes a frame means which is secured to the hoisting cable of the tower crane. A first cable is mounted on a first sheave means secured to the lower end of the frame means. The ends of the first cable are secured to the upper end of the building panel. A hydraulically operated winch is mounted on the frame means and has a winch cable extending downwardly therefrom which is secured to one side of the building panel adjacent the lower end thereof. The tower crane is initially activated so that the hoisting cable thereof is moved upwardly which causes the frame means and the first cable to also move upwardly which raises the building panel from the truck bed. When the panel has been sufficiently raised from the truck bed, the remotely controlled winch is operated so that the winch cable is lowered which causes the building panel to be rotated 90° and to be supported by the first cable.

The winch is operated by means of a hydraulic motor operatively connected thereto through a spring engaged, hydraulic release brake and worm gear reducer. In the event that the hydraulic motor should fail, the hydraulic brake prevents the lowering of the winch cable.

DESCRIPTION OF THE PREFERRED EMBODIMENT

Figure 1:
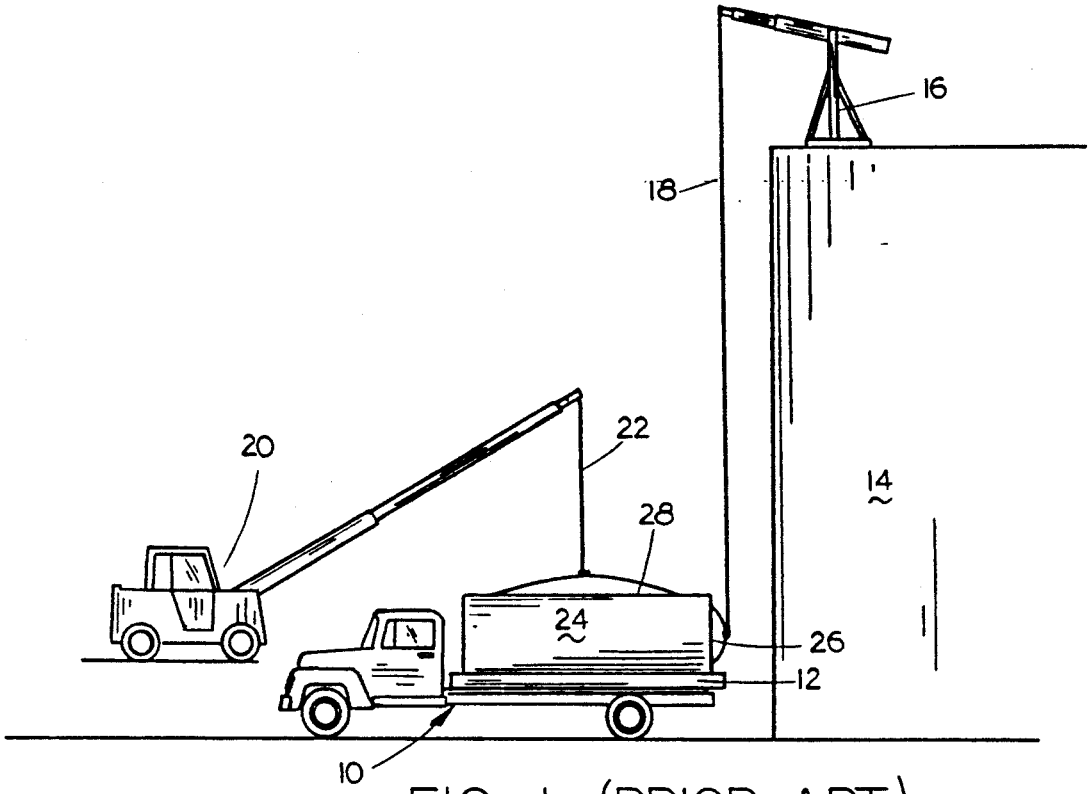
FIG. 1 (PRIOR ART)
FIGS. 1 and 2 illustrate the prior art manner in which building panels were previously raised from the bed of a truck for installation on the side of a building.
Figure 2:
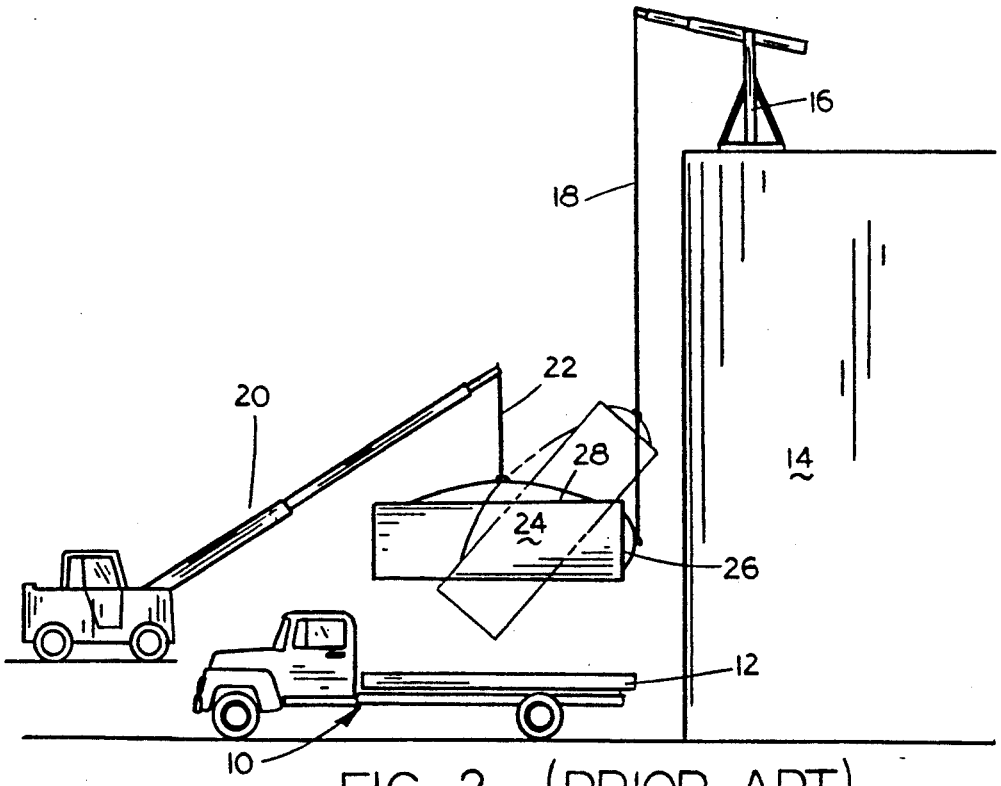
FIG. 2 (PRIOR ART)

FIGS. 1 and 2 illustrate the manner in which building panels were previously raised from the bed of a truck used to transport the building panels to a building site. In FIGS. 1 and 2, the numeral 10 refers to a conventional truck or trailer including a bed 12. The numeral 14 refers to the building under construction with the numeral 16 identifying a conventional tower crane or the like having a hoisting cable 18 extending downwardly therefrom. The numeral 20 refers to a mobile crane located at the building site having a hoisting cable 22.

When the building panel 24 arrives at the building site, the hoisting cable 18 of the building panel is first connected to the upper end 26 of the building panel 24 with the hoisting cable 22 being connected to the side edge 28 of the panel 24 in the manner illustrated in FIG. 1. Crane 20 is initially operated so that hoisting cable 22 lifts the panel 24 from the bed of the truck. When the panel 24 has been raised sufficiently as illustrated in FIG. 2, the tower crane 16 is operated to cause the hoisting cable 18 to be moved upwardly. Ordinarily, crane 20 is simultaneously operated with the crane 16 to cause the hoisting cable 22 to be lowered as the hoisting cable 18 is moved upwardly so that the panel 24 is rotated 90° so that the upper end of the panel is positioned in the proper attitude. The prior art method illustrated in FIGS. 1 and 2 requires the presence of the crane 20 at the building site which does represent a considerable expense.

To overcome the shortcomings of the prior art method of FIGS. 1 and 2, the remotely controlled winch means 30 as illustrated in FIGS. 3–10 has been provided. Means 30 includes a frame means 32 having support legs 34 extending downwardly therefrom to enable the winch means to be supported on a suitable support surface when not in use. Selectively closable access covers 36, 38 and 40 are provided to permit access to the interior of the winch means as required. In accordance with O.S.H.A. regulations, the doors 36 and 40 must be bolted shut or electrically interlocked.

A pair of batteries 42 and 44 are mounted on the inside surface of access cover 36 and provide power to the hydraulic pump and radio receiver as will be described in more detail hereinafter. Batteries 42 and 44 may be re-charged by means of the battery charger 46. Hydraulic pump 48 is in communication with oil in oil reservoir 50 and is hydraulically connected to hydraulic motor 52 by suitable valving. Hydraulic motor 52 is operatively connected to a vertically disposed rotatable shaft 54 having sprocket 56 mounted at the upper end thereof. Hydraulic brake 58 is provided to prevent rotation of shaft 54 should hydraulic failure occur.

Chain 60 extends around sprocket 56 and extends around sprocket 62 mounted on shaft 64 of a "Cone Drive" worm gear reducer 66. The output shaft 68 of gear reducer 66 is operatively connected to a rotatable winch drum 70 having cable 70 mounted thereon and extending downwardly therefrom. Sprocket 74 is mounted at the outer end of shaft 68 and has chain 76 positioned thereon. Chain 76 extends around sprockets 78 and 80 mounted on shafts 82 and 84 respectively. The numeral 86 refers to a levelwind assembly 86 including a screw shaft 88 which may comprise the shaft 84 or which may be a separate component thereof At any rate, rotation of sprocket 84 causes the cable 72 to be wound onto the winch drum 70 or wound therefrom. The numeral 90 refers to a cable tensioning apparatus designed to keep the cable 72 tightly wound on the drum 70.

Figure 3:
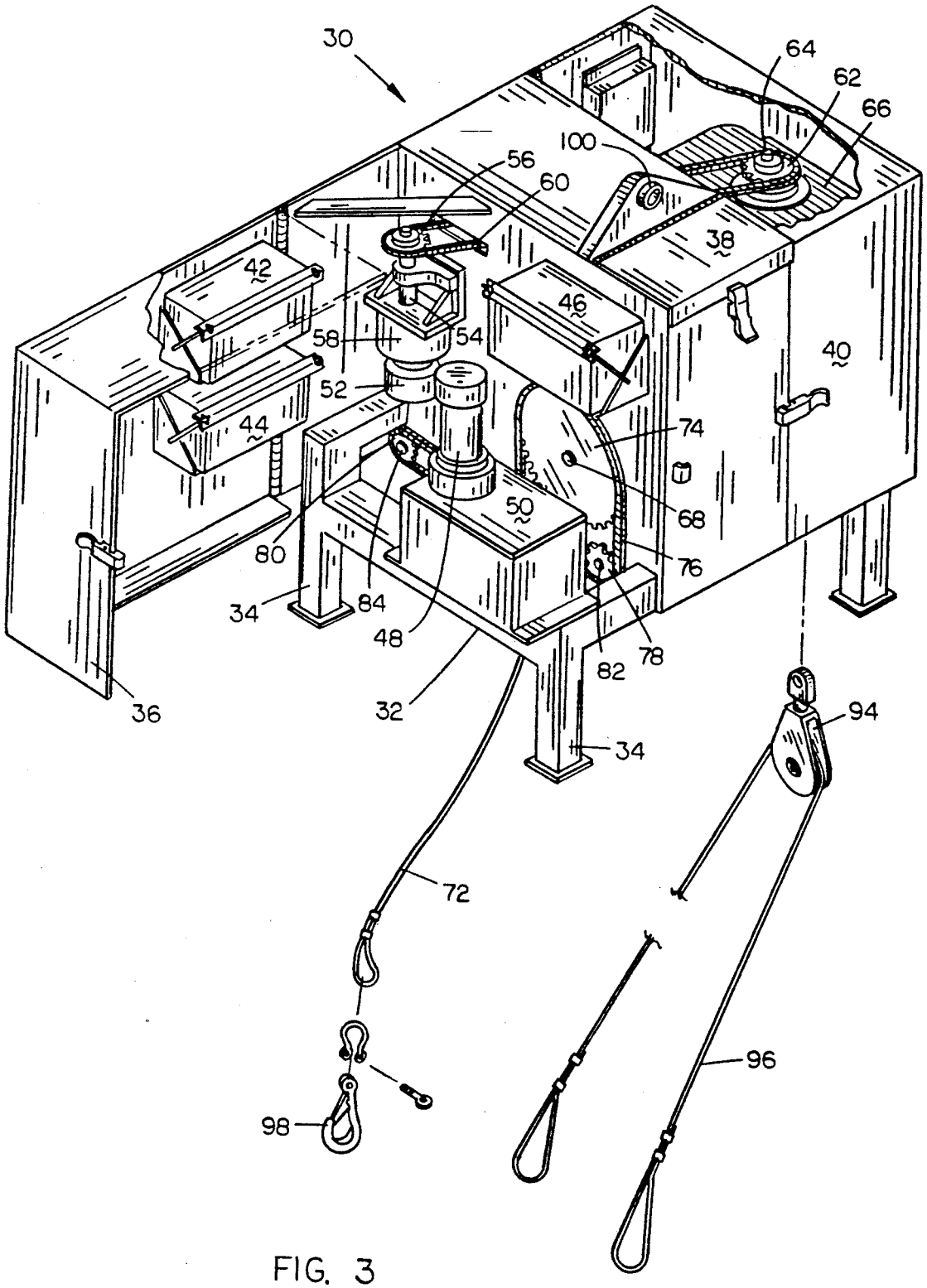
FIG. 3 is a perspective view of the remotely controlled winch means of this invention with portions thereof cut-away and with an access door in an open position to more fully illustrate the invention.
Figure 5:
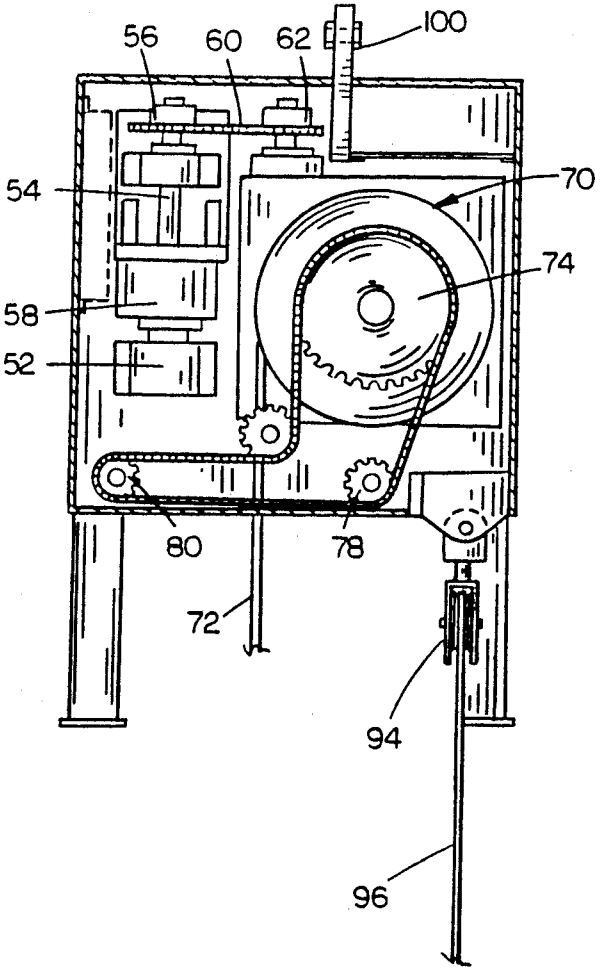
FIG. 5 is a sectional view of the winch means of this invention as seen on lines 5—5 of FIG. 4.
Figure 4:
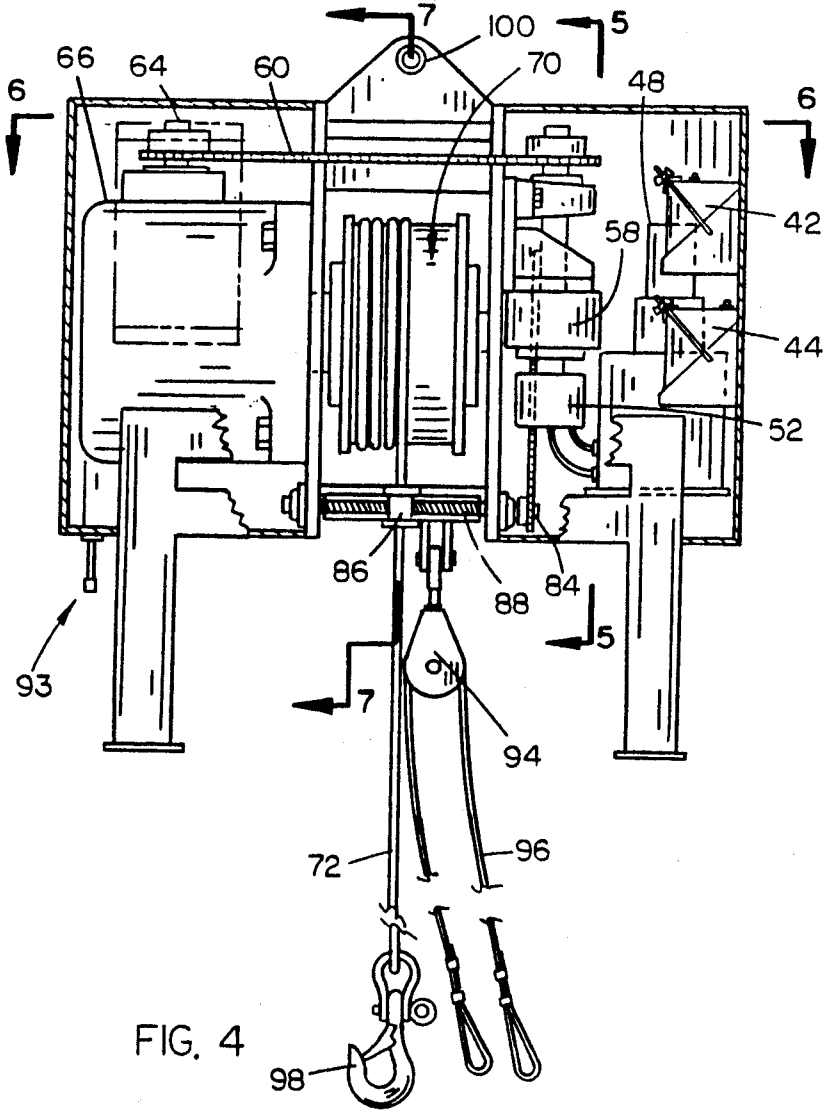
FIG. 4 is a vertical sectional view of the remotely controlled winch means of this invention.
Figure 7:
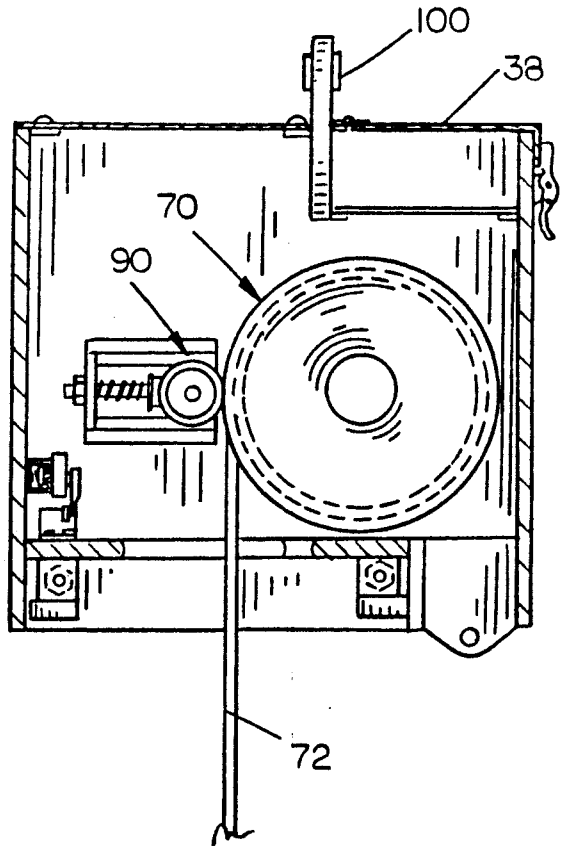
FIG. 7 is a sectional view of the winch means of this invention as seen on lines 7—7 of FIG. 6.
Figure 6:
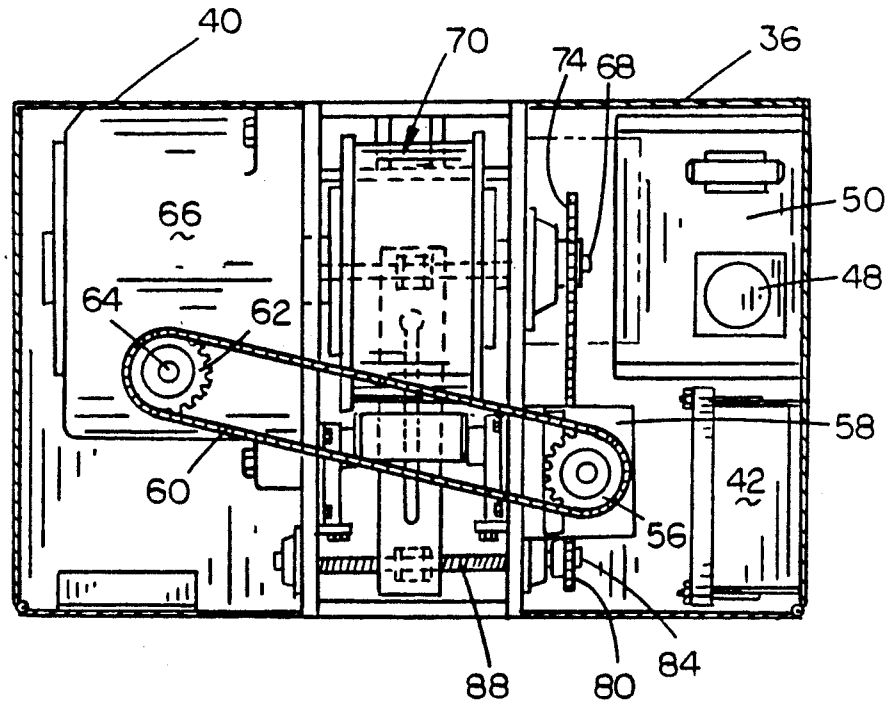
FIG. 6 is a sectional view of the winch means of this invention as seen on lines 6—6 of FIG. 5.

A suitable radio receiver 92 including an antenna 93 is provided on the apparatus for receiving radio signals from the radio transmitter 92 on the tower crane 16. Swivel shackle 94 is secured to the frame means 32 by any conventional fashion and has cable 96 positioned thereon. As seen in FIG. 3, a suitable hook vise 98 is provided at the lower end of cable 72.

Figure 8:
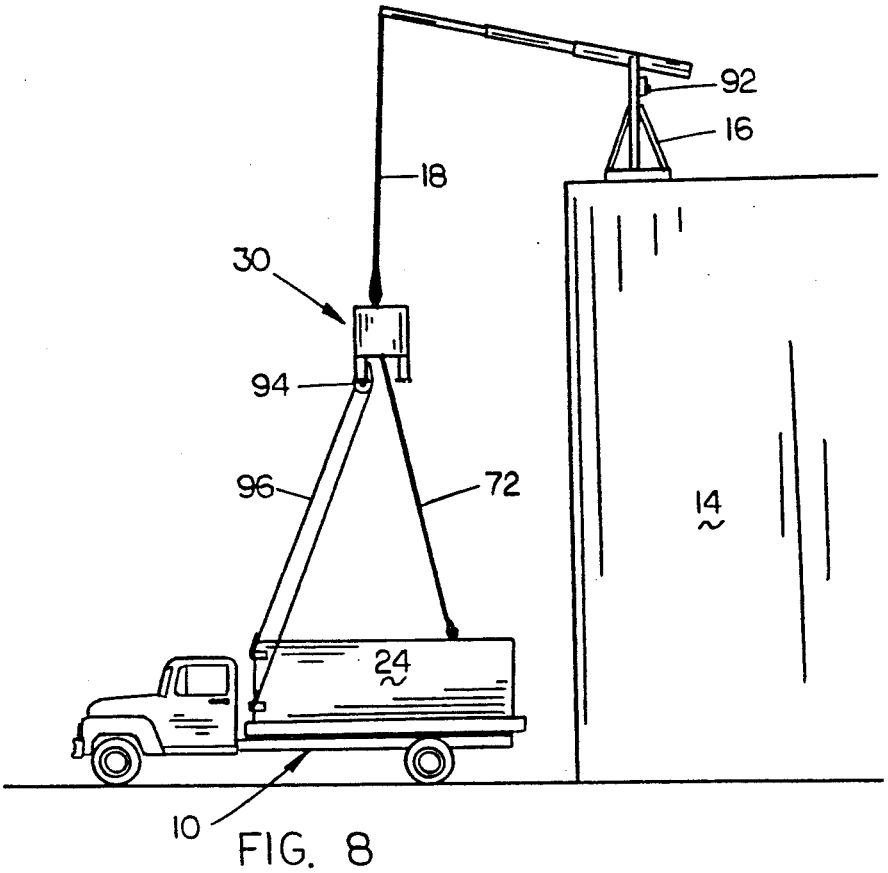
FIGS. 8–10 illustrate the sequence of operation of the winch means of this invention.
Figure 10:
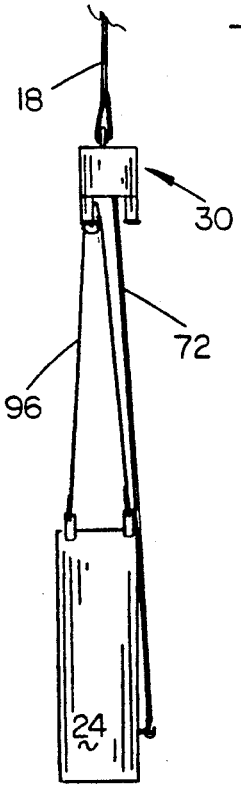
Figure 9:
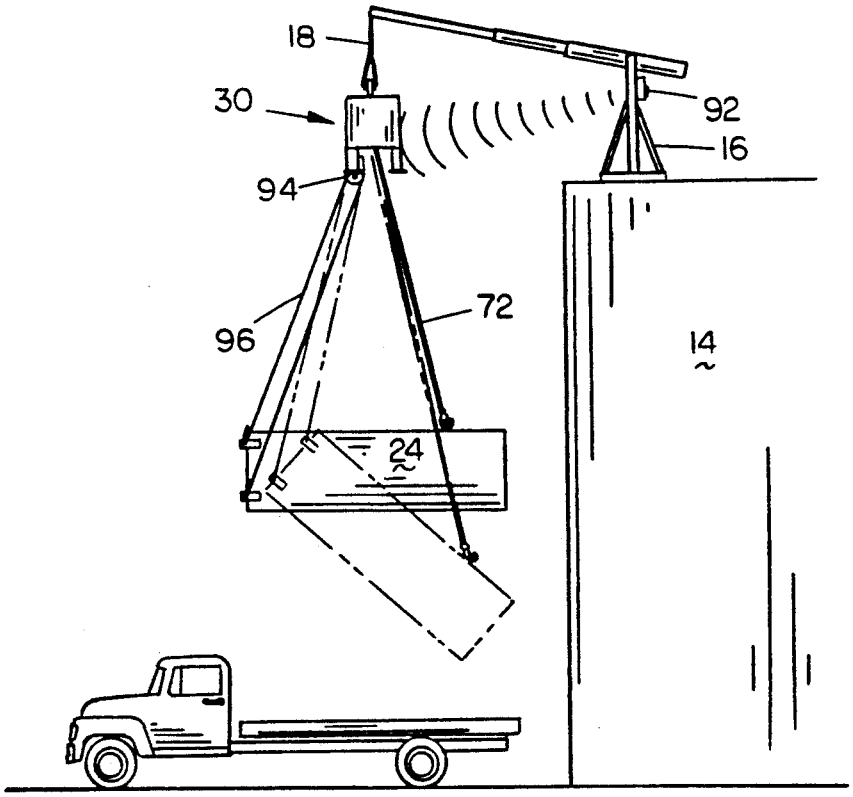

In use, the building panel 24 is brought to the building site as illustrated in FIG. 9 with the panel resting on one of its side edges with the upper end thereof being positioned adjacent to the cab of the truck 10. Cable 96 is secured to the upper end of the building panel 24 as illustrated in FIG. 8 and the hook 98 on winch cable 72 is secured to the side edge of the panel 24 adjacent the lower end of the panel 24 as illustrated in FIG. 8. Tower crane 16 is then operated to cause hoisting cable 18 to be moved upwardly which causes the frame means 32, winch cable 72 and cable 96 to be moved upwardly which causes the panel 24 to be lifted or raised from the bed of the truck as illustrated in FIG. 9.

When the panel 24 has been raised sufficiently from the bed of the truck, transmitter 92 is actuated to cause the hydraulic pump 48 to be actuated thereby causing the actuation of hydraulic motor 52 which in turn causes the gear reducer 66 to rotate the winch drum so that the cable 72 may unwind therefrom. The hydraulic motor 58 and the gear reducer 66 cooperate to prevent the cable 72 from unwinding from the drum at too rapid a pace. In the event that a hydraulic failure should occur, hydraulic brake 58 prevents rotation of shaft 54 which thereby prevents further rotation of the winch drum thereby preventing the cable 72 from further unwinding from the drum. As winch cable 72 is lowered, the panel is rotated 90° from the position illustrated by solid lines in FIG. 9 to the position of FIG. 10. Lowering the winch cable 72 relative to frame means 30 causes the cable 96 to move relative to the sheave block 94. The tower crane 16 is then operated to cause the panel 24 to be positioned adjacent exterior of the building for attachment to the building.

When the panel has been properly positioned, cables 72 and 96 are disconnected from the panel 24. The hydraulic motor 52 is then operated to wind the cable 72 onto the drum of the winch for the next operation. Levelwind assembly 86 ensures that the cable 72 will be properly wound onto the winch drum. Levelwind assembly 86 preferably includes end of travel limit switches referred to generally by the reference numeral 100.

Thus it can be seen that a novel apparatus has been provided which may be used in combination with a tower crane or the like to raise or lift a building panel from a truck bed and to properly position the building panel relative to the building. The apparatus of this invention eliminates the need of a second crane at the job site which substantially reduces the cost associated therewith. The winch of this invention, when used on a single line crane, eliminates the tangling of lines which is common in double line cranes. Thus it can be seen that the invention accomplishes at least all of the stated objections.

I claim:

1. An apparatus for use with a hoisting crane, including a hoisting cable, to enable the hoisting crane to lift a building panel from the bed of a truck, the building panel having an upper end, a lower end and first and second side edges, said panel being normally positioned on said first side edge on the truck bed, comprising, a frame having upper and lower ends, said hoisting cable being secured to the upper end of said frame, a first sheave operatively secured to said frame at the lower end thereof, a second cable extending around said first sheave and having opposite ends, said opposite ends of said second cable being adapted to be secured to the upper end of said building panel in a spaced-apart manner, a winch mounted on said frame, said winch comprising a winch drum having a winch cable wrapped thereon and extending downwardly from said winch drum with the free end of said winch cable being operatively secured to said second side edge of said building panel adjacent the lower end thereof, so that upward vertical movement of said hoisting cable will cause said frame, said second cable, and said winch cable to be moved upwardly, without activating said winch, thereby causing said building panel to be raised from the bed of the truck;

and means for selectively operating said winch so that said winch cable may be unwound from said winch drum and lowered relative to said frame after said hoisting cable has sufficiently raised the building panel from the bed of the truck so that the building panel may be rotated 90° and so that said second cable supports the building panel by its upper end, said first sheave permitting length compensation of said second cable during the rotation of said building panel, said means for selectively operating said winch including means for winding said winch cable onto said winch drum once said winch cable has been released from said building panel, said means for selectively operating said winch including a remotely controlled hydraulic pump and motor operatively connected thereto.

2. The apparatus of claim 1 further including control means for remotely controlling said hydraulic pump and motor, said control means comprising a radio receiver operatively connected to said hydraulic pump and motor, and a radio transmitter adapted to transmit radio signals to said radio receiver so that said hydraulic pump and motor may be selectively activated.

3. The apparatus of claim 1 wherein a hydraulic brake is operatively connected to said hydraulic pump and motor.

4. The apparatus of claim 1 wherein said hydraulic pump and motor is connected to said winch through a hydraulic brake and a gear reducer.

* * * * *